US010726820B2

(12) United States Patent
Watson

(10) Patent No.: US 10,726,820 B2
(45) Date of Patent: Jul. 28, 2020

(54) ADHESION CONTACT PAD FOR MUSICAL INSTRUMENTS AND METHOD

(71) Applicant: Tony Watson, Stockbridge, GA (US)

(72) Inventor: Tony Watson, Stockbridge, GA (US)

( * ) Notice: Subject to any disclaimer, the term of this patent is extended or adjusted under 35 U.S.C. 154(b) by 0 days.

(21) Appl. No.: 15/792,729

(22) Filed: Oct. 24, 2017

(65) Prior Publication Data

US 2018/0166051 A1 Jun. 14, 2018

Related U.S. Application Data

(60) Provisional application No. 62/432,441, filed on Dec. 9, 2016.

(51) Int. Cl.

| | |
|---|---|
| ***G10G 7/00*** | (2006.01) |
| ***G10D 13/00*** | (2020.01) |
| ***G10D 9/00*** | (2020.01) |
| ***G10D 3/00*** | (2020.01) |

(52) U.S. Cl.

CPC ..... *G10G 7/00* (2013.01); *G10D 3/00* (2013.01); *G10D 9/00* (2013.01); *G10D 13/00* (2013.01)

(58) Field of Classification Search

CPC ..... G10G 7/00; G10D 9/00; G10D 13/00; G10D 3/00

See application file for complete search history.

(56) References Cited

U.S. PATENT DOCUMENTS

| | | | | |
|---|---|---|---|---|
| 4,084,477 | A * | 4/1978 | Dominguez | G10D 3/00 24/450 |
| 4,998,959 | A * | 3/1991 | Purdie | G10D 9/06 84/400 |
| 5,103,709 | A * | 4/1992 | Foss, Jr. | G10G 7/00 84/327 |
| 5,939,652 | A * | 8/1999 | Jones | G10D 3/18 84/278 |
| 6,627,801 | B2 | 9/2003 | Casamento | |
| 9,196,233 | B2 * | 11/2015 | Schulze | G10D 3/18 |
| 2003/0029300 | A1 * | 2/2003 | Okada | G10D 9/043 84/380 R |
| 2007/0006713 | A1 * | 1/2007 | Dunlop | G10D 3/163 84/322 |
| 2014/0109749 | A1 * | 4/2014 | Schulze | G10D 3/18 84/453 |

* cited by examiner

*Primary Examiner* — Kimberly R Lockett
(74) *Attorney, Agent, or Firm* — Charles Runyan

(57) ABSTRACT

A musical instrument protection system includes a plurality of pad devices each having any shape, a body including an adhesive side, a contact side, and a thickness. The pad device is defined by the adhesive side and the contact side, separated by the thickness which can be any color or design. The contact side may be in contact with a hand of a user during an in-use installed condition, and the adhesive side is configured to be adhered to an outer surface of a musical instrument such that it provides a protective barrier for protecting finished outer surfaces, preserving and sometimes enhancing the acoustics of the musical instrument.

6 Claims, 5 Drawing Sheets

ADHESION CONTACT PAD FOR MUSICAL INSTRUMENTS AND METHOD

CROSS-REFERENCE TO RELATED APPLICATION(S)

The present application is related to and claims priority to U.S. Provisional Patent Application No. 62/432,441 filed Dec. 9, 2016, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

Technical Field

The present invention relates generally to the field of protective pads of existing art and more specifically relates to an adhesive protective acoustic pad for a musical instrument.

Related Art

Unprotected musical instruments are often damaged at contact points from the user's body or other objects. The finish on an instrument can be eroded by acids, dirt, and moisture, often caused by the user's hands. Covering any area of an instrument with any material will affect the sound and not covering the instrument can potentially leave a residue on the instrument. This is undesirable.

Many people enjoy playing musical instruments. A musical instrument is created or adapted to make musical sounds. The shape and form of the wind instrument along with structures for restricting the flow of air through the instrument produce specific tones, tone ranges and overtones in the sound spectrum. Wind instruments are typically made in metallic, plastic or wood form, acoustic string and percussion instruments are typically made from combinations of wood, plastic and/or metals. All of these instruments have finishes that enhance the aesthetics of the instrument. A solution to keep the instruments in pristine condition without degrading the sound is desirable.

U.S. Pat. No. 6,627,801 to Michael John Casamento relates to a finish protection device for stringed musical instruments. The described finish protection device for stringed musical instruments includes a device for protecting the finish applied to the wood and other component parts of certain stringed musical instruments, comprising a device fabricated from a sheet of highly plasticized vinyl film, appropriately sized and shaped so as to conform to the area requiring protection. Once applied, the device forms a second skin over the finish thereby preventing damage from abrasion, and other harmful elements such as skin oils, and perspiration. The self-adherent properties of the material allow the device to be attached to the instrument without fasteners or adhesives. The device may be repeatedly applied and removed without damage to the instrument's finish, or degradation in its adhesive qualities. In addition, the device is inherently strong, thin, flexible, and extremely light in weight, preventing any adverse effects on the original looks, feel, and tonal qualities of the instrument.

SUMMARY OF THE INVENTION

In view of the foregoing disadvantages inherent in the known protective pad art, the present disclosure provides a novel adhesive protective pad for all acoustic musical instruments that can be printed to any color to enhance the appearance of the instrument. The general purpose of the present disclosure, which will be described subsequently in greater detail, is to provide an adhesive protective pad for a musical instrument to provide protection to the host instrument, while also preserving and sometimes enhancing the sound spectrum or appearance of the instrument.

A musical instrument protection system is disclosed herein. The musical instrument protection system includes a plurality of pad devices each having a body including an adhesive side, a contact side, and a thickness. The pad device is defined by the adhesive side, a vinyl or plastic medium that can be printed and an overlaminate of vinyl or cloth for the contact side, separated by the thickness. The contact side may be in contact with a hand of a user during an in-use installed condition, and the adhesive side is configured to be adhesively attached to an outer surface of a musical instrument such that it adhesively provides a protective barrier for protecting finished outer surfaces in strategic places of the musical instrument. The plurality of pad devices may be collectively provided on a single sheet and selectively shaped and applied to the musical instrument per user preference and to fit their individual grip. The pad may be cut from the sheet or may have suggested shapes printed on the backer or come in a pre-punched form. The adhesive side may not cause damage or leave residue when applied and alternatively removed from the outer surface of the instrument. The device may enhance grip, comfort, sound spectrum and appearance of the musical instrument for a musician.

According to another embodiment, a method of using a musical instrument protection system is also disclosed herein. The method of using a musical instrument protection system includes providing the musical instrument protection system including a plurality of pad devices, (cutting/preparing then) installing at least one plurality of pad devices on an outer surface of a musical instrument, using the musical instrument for play, removing the plurality of pad devices.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, an adhesive protective pad for a musical instrument, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a protective acoustic pad and more particularly to an adhesive protective pad for a musical instrument as used to provide a protective barrier for protecting finished outer surfaces of the musical instrument.

Generally speaking, the present invention provides a reusable adhesion acoustic pad designed to protect musical instruments from acids, dirt, and moisture. Strategically placed, it preserves, modifies, and enhances the tonal characteristics of wind, string, or percussion instruments. This prevents damage to musical instruments that can occur due to wear at unprotected contact points with the user's body or other object. It can enhance the grip, comfort, sound spectrum and appearance of the instrument for the musician. This offers a thin, pliable material that can be cut into any shape, custom printed any color or design and adheres to the instrument and leaves little to no residue when removed.

Musical instrument protection system offers a plurality of pad devices for protecting musical instruments. The device is comprised of a thin piece of adhesion material that can be attached to a musical instrument without leaving residue. The pad device material can be cut into any shape and be made to fit complex curves for the desired comfort, printed for any desired appearance, provide protection, and/or enhance tonal results for each instrument. It may be of any thin pliable material that should be reusable and washable. The material should be thin and is designed to cover only small areas of the instrument on contact points.

Figure 1:
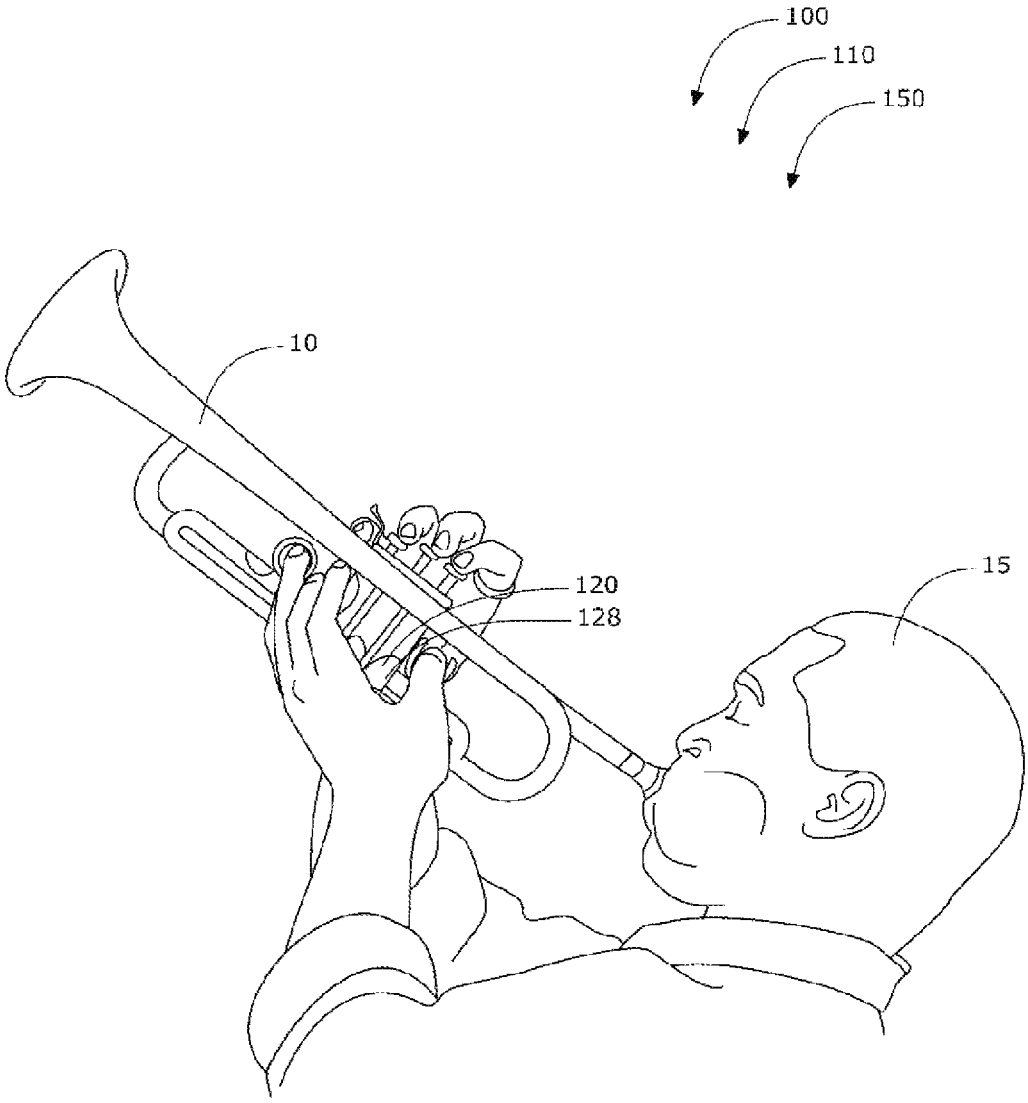
FIG. 1 is a perspective view of a musical instrument protection system during an 'in-use' condition, according to an embodiment of the disclosure.

Referring now more specifically to the drawings by numerals of reference, there is shown in FIGS. 1-4, various views of a musical instrument protection system 100. FIG. 1 shows a musical instrument protection system 100 during an 'in-use' condition 50, according to an embodiment of the present disclosure. Here, the musical instrument protection system 100 may be beneficial for use by a user 40 to provide a protective barrier for protecting finished said outer surfaces of said musical instrument 10. As illustrated, the musical instrument protection system 100 may include a plurality of pad devices 110 each having a body 120 including an adhesive side 124, a contact side 128, and a thickness 134 which can be printed in some embodiments. In other embodiments the thickness 134 may not be printed. Each of the pad devices 110 are defined by the adhesive side 124 and the contact side 128, separated by the thickness 134. The contact side 128 is in contact with a hand of a user 15 during an in-use installed condition, and the adhesive side 124 is configured to be adhesively attached to an outer surface of a musical instrument 10 such that it provides a protective barrier for protecting finished outer surfaces of the musical instrument 10. It should be appreciated that the body 120 may be arranged as one layer in some embodiments. Further, in some embodiments, the body 120 may include at least two layers or more.

According to one embodiment, the musical instrument protection system 100 may be arranged as a kit 105. In particular, the musical instrument protection system 100 may further include a set of instructions 107. The instructions 107 may detail functional relationships in relation to the structure of the musical instrument protection system 100 such that the musical instrument protection system 100 can be used, maintained, or the like, in a preferred manner.

Figure 2A:
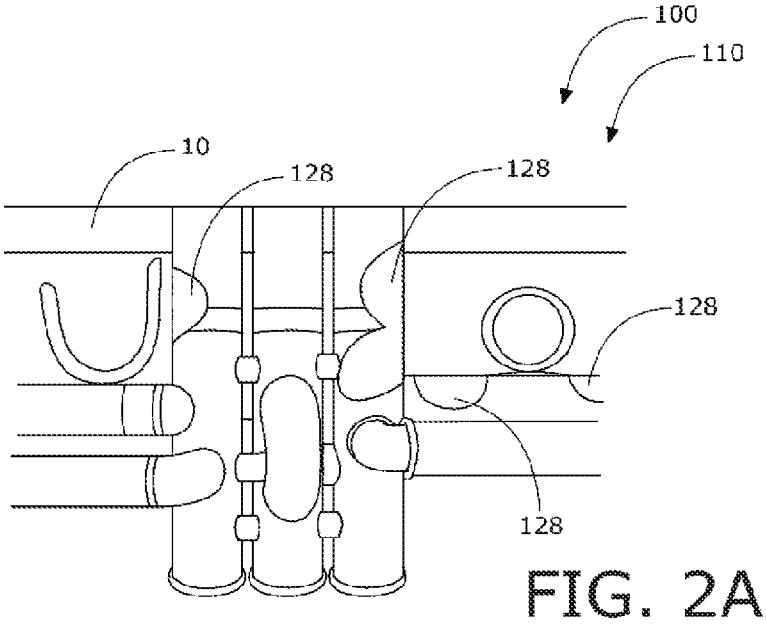
FIG. 2A is a perspective view of the musical instrument protection system of FIG. 1, according to an embodiment of the present disclosure.
Figure 2B:
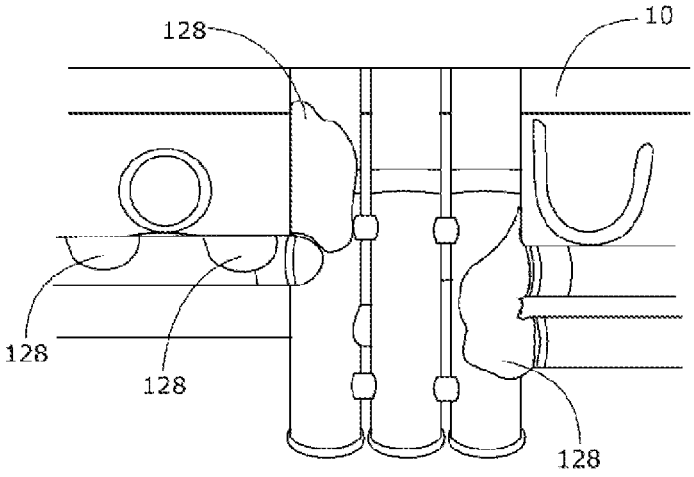
FIG. 2B is a perspective view of the musical instrument protection system of FIG. 1, according to an embodiment of the present disclosure.

FIG. 2 shows the musical instrument protection system 100 of FIG. 1, according to an embodiment of the present disclosure. As above, the musical instrument protection system 100 may include a plurality of pad devices 110 each having a body 120 including an adhesive side 124, a contact side 128, and a thickness 134. The pad device is defined by the adhesive side 124 and the contact side 128, and separated by the thickness 134. The contact side 128 of the body 120 of the pad may comprise vinyl contact material or cloth contact material. The adhesive side 124 may comprise adhesive. The adhesive on the adhesive side 124 may be removable and reusable. The adhesive may comprise a static-adhesive or glue-adhesive or other suitable equivalent. The musical instrument 10 may comprise a brass, string, woodwind, or percussion musical instrument 10.

Figure 3:
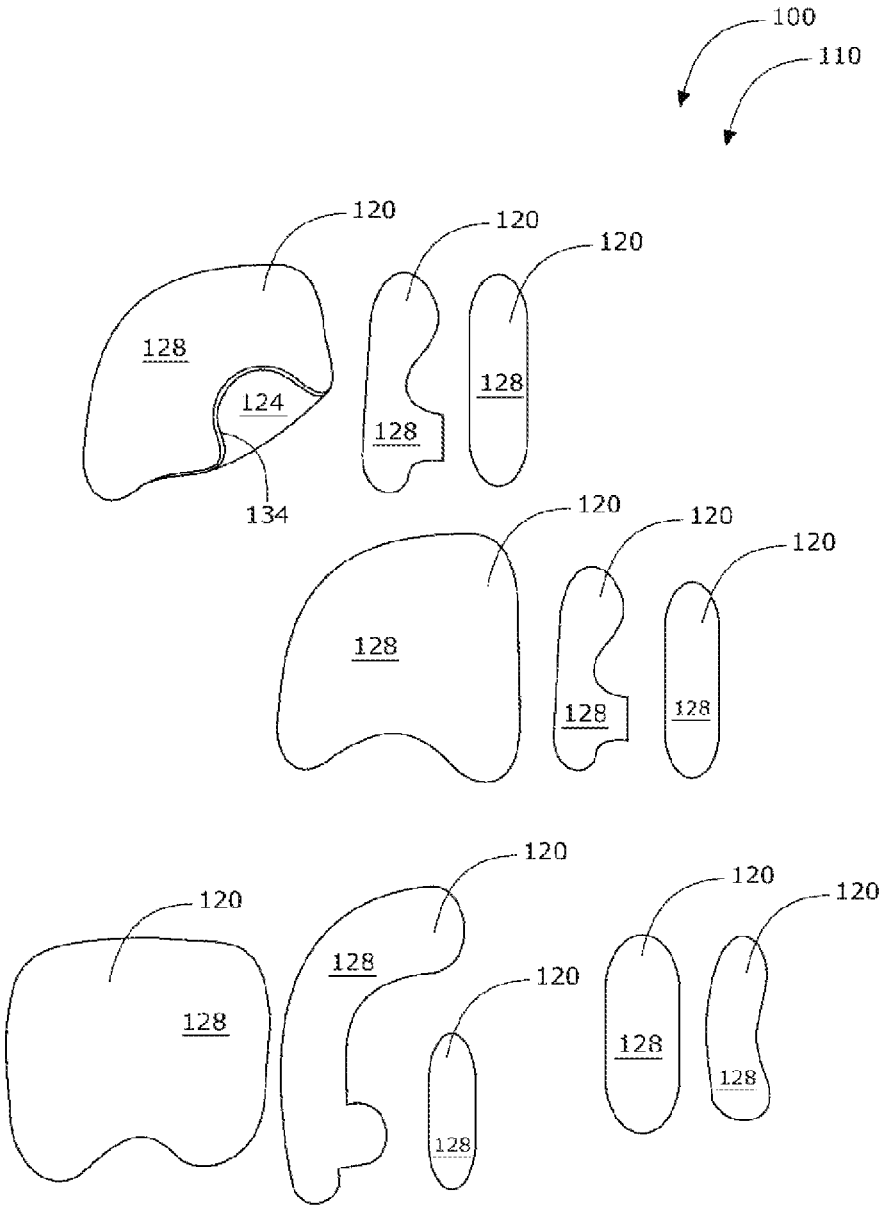
FIG. 3 is a perspective view of the musical instrument protection system of FIG. 1, according to an embodiment of the present disclosure.

FIG. 3 is a perspective view of the musical instrument protection system 100 of FIG. 1, according to an embodiment of the present disclosure. As above, the musical instrument protection system 100 may include a plurality of pad devices 110 for applying to a musical instrument 10 for providing a protective barrier for protecting finished outer surfaces and may sometimes preserve or enhance the acoustics of the musical instrument 10. In a preferred embodiment, the plurality of pad devices 110 may be collectively provided on a single sheet. The plurality of pad devices 110 may be configured to be cut to shape-fit to specific the outer surfaces of the musical instrument 10. The pad device material can be cut into any shape for the desired comfort, appearance, protection, and/or tonal results for the musical instrument 10. Further, the plurality of pad devices 110 may be individually stamped. Imaging options may include latex printing, UV cured printing, and the like.

Figure 4:
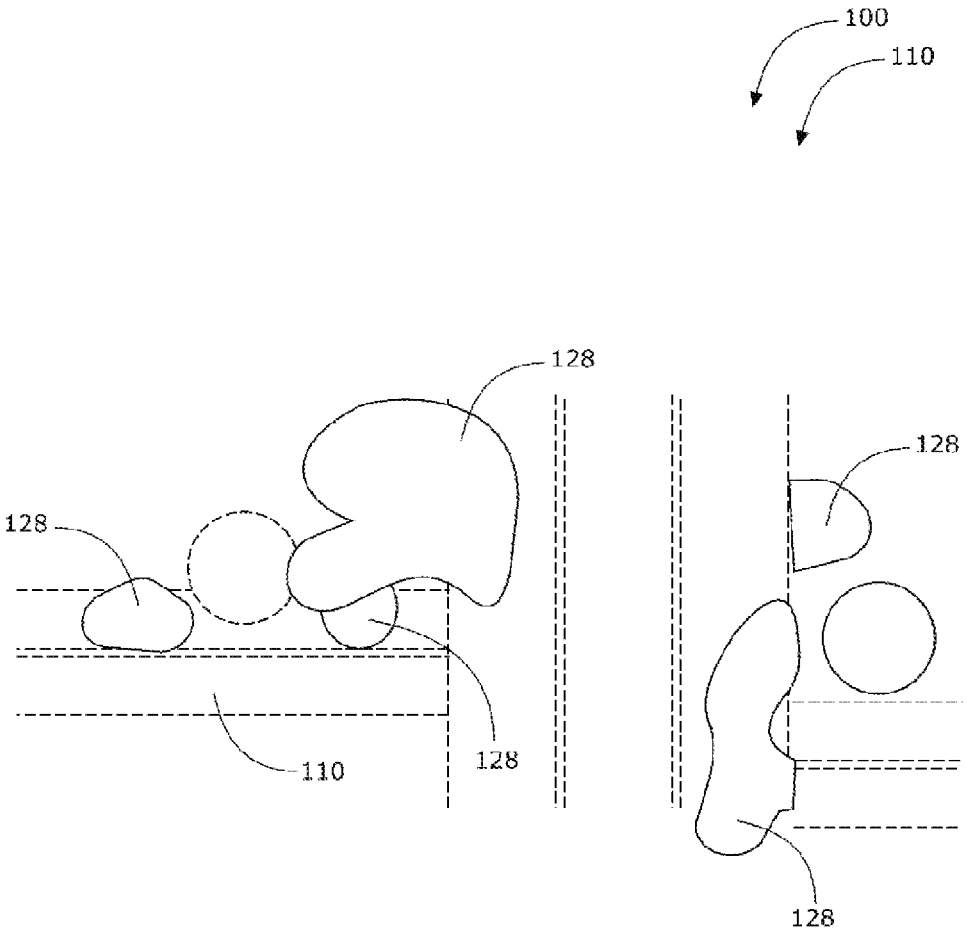
FIG. 4 is a perspective view of the musical instrument protection system of FIG. 1, according to an embodiment of the present disclosure.

FIG. 4 is a perspective view of the musical instrument protection system 100 of FIG. 1, according to an embodiment of the present disclosure. The plurality of pad devices 110 may be flexible and may be configured to contour to specific outer surfaces of a musical instrument 10 such as a brass, string, woodwind, or percussion musical instrument 10. The adhesive side 124 may not cause damage to and alternately tarnish the specific outer surfaces of the musical instrument 10 when applied and alternatively removed. The plurality of pad devices 110 may be removed from the specific outer surfaces of the musical instrument 10 without leaving any residue.

Figure 5:
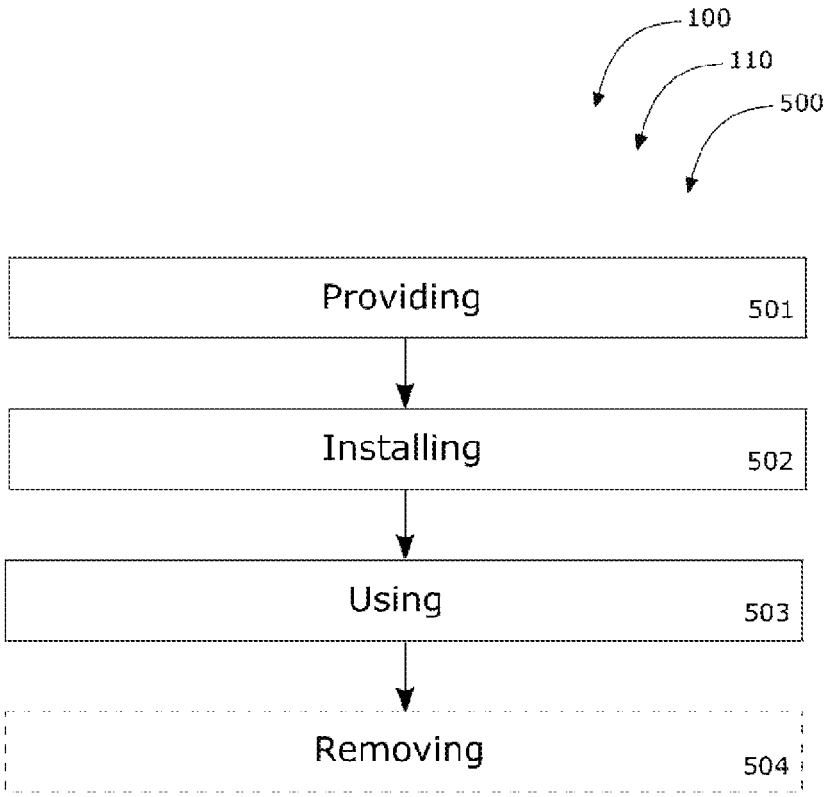
FIG. 5 is a flow diagram illustrating a method of use for installing a plurality of pad devices, according to an embodiment of the present disclosure.

FIG. 5 is a flow diagram 550 illustrating a method for use 500 providing a protective barrier for protecting finished the outer surfaces and sometimes preserving or enhancing the acoustics of said musical instrument 10, according to an embodiment of the present disclosure. In particular, the method for providing a protective barrier for protecting finished said outer surfaces of the musical instrument 500 may include one or more components or features of the musical instrument protection system 100 as described above. As illustrated, the method 500 for providing preserved acoustics and a protective barrier for protecting finished said outer surfaces of said musical instrument may include the steps of: step one 501, providing the musical instrument protection system 100 including a plurality of pad devices 110; step two 502, installing at least one of the plurality of pad devices 110 on an outer surface of a musical instrument 10; step three 503, using the musical instrument 10 for play; step four 504, removing the plurality of pad devices 110.

It should be noted that step four 504 is an optional step and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for removing before installing the pad to the instrument may include cutting or otherwise removing it from the sheet to install to the musical instrument 10, are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A musical instrument protection system, the system comprising:

a pad device having a body including an adhering side, a contact side, and a material;

wherein said contact side is configured to contact a user;

wherein said material can be clear, colored, or custom printed or designed;

wherein the pad device can be cut;

wherein said adhering side is configured to adhere the pad device to an outer surface of a musical instrument to provide a protective barrier; and wherein the pad device is provided on a single sheet.

2. The musical instrument protection system of claim 1, wherein said adhering side is configured not to damage or tarnish said outer surfaces.

3. The musical instrument protection system of claim 1, wherein said pad device does not leave residue on said outer surface.

4. A musical instrument protection system comprising:

a pad device-having a body including an adhering side, a contact side, and a material;

wherein said contact side contacts a user;

wherein said adhering side is configured to be adhesively attached to an outer surface of a musical instrument such that the pad provides a protective barrier on said outer surface;

wherein said contact side comprises cloth or vinyl contact material;

wherein said adhering side comprises adhesive;

wherein the adhesive on the adhering side is removable;

wherein the adhesive on the adhering side is reusable;

wherein the pad device is configured to be cut to shape said outer surface;

wherein the musical instrument is a brass instrument;

wherein the pad device is flexible and is configured to contour to said outer surface;

wherein a plurality of pad devices is provided on a single sheet;

and wherein said adhering side is configured not to damage or tarnish said outer surface.

5. The musical instrument protection system of claim 4, further comprising a set of instructions; and wherein the musical instrument protection system is arranged as a kit including a pad device.

6. A musical instrument protection system comprising:

a pad device-having a body including an adhering side, a contact side, and a material;

wherein said contact side contacts a user;

wherein said adhering side is configured to be adhesively attached to an outer surface of a musical instrument such that the pad provides a protective barrier on said outer surface;

wherein said contact side comprises cloth or vinyl contact material;

wherein the adhesive on the adhering side is removable;

wherein the adhesive on the adhering side is reusable;

wherein the pad device is configured to be cut to shape said outer surface;

wherein the pad device is flexible and is configured to contour to said outer surface;

wherein a plurality of pad devices is provided on a single sheet;

and wherein said adhering side is configured not to damage or tarnish said outer surface.

* * * * *